US012516512B2

(12) United States Patent
Sulecki

(10) Patent No.: US 12,516,512 B2
(45) Date of Patent: Jan. 6, 2026

(54) DRAIN TRAP ASSEMBLY

(71) Applicant: Zebby Sulecki, Newtown Square, PA (US)

(72) Inventor: Zebby Sulecki, Newtown Square, PA (US)

( * ) Notice: Subject to any disclaimer, the term of this patent is extended or adjusted under 35 U.S.C. 154(b) by 26 days.

(21) Appl. No.: 18/305,082

(22) Filed: Apr. 21, 2023

(65) Prior Publication Data

US 2024/0352720 A1 Oct. 24, 2024

(51) Int. Cl.
*E03C 1/29* (2006.01)

(52) U.S. Cl.
CPC ..... *E03C 1/29* (2013.01)

(58) Field of Classification Search
CPC ... E03C 1/29; E03C 1/30; E03C 1/282; E03C 1/284; Y10T 137/4591; Y10T 137/4553; Y10T 137/4613; Y10T 137/4561; Y10T 137/4568
USPC ..... 137/247.51
See application file for complete search history.

(56) References Cited

U.S. PATENT DOCUMENTS

| | | | | | |
|---|---|---|---|---|---|
| 340,202 | A * | 4/1886 | Edwards | E03D 9/02 | 137/247.35 |
| 4,371,991 | A * | 2/1983 | Schrott | E03C 1/30 | 4/679 |
| 5,159,724 | A * | 11/1992 | Vosper | E03C 1/284 | 137/247.35 |
| 9,428,893 | B1 * | 8/2016 | Towers | E03C 1/29 | |
| 11,732,458 | B2 * | 8/2023 | Amzallag | F04F 10/00 | 137/123 |
| 2002/0088051 | A1 * | 7/2002 | Nunez | E03C 1/29 | 4/679 |
| 2004/0177439 | A1 * | 9/2004 | Nunez | E03C 1/29 | 4/679 |

FOREIGN PATENT DOCUMENTS

| | | | | |
|---|---|---|---|---|
| CH | 131762 A | * | 3/1929 | |
| CH | 165442 A | * | 11/1933 | |
| DE | 599987 C | * | 6/1934 | |
| FR | 579249 A | * | 10/1924 | |
| FR | 713651 A | * | 10/1931 | |
| FR | 717648 A | * | 1/1932 | |
| FR | 801052 A | * | 7/1936 | |
| GB | 975180 A | * | 11/1964 | |
| GB | 1385248 A | * | 2/1975 | E03C 1/29 |

OTHER PUBLICATIONS

Translation of DE599987 retrieved from espacenet.com (Year: 2023).*
Machine Translation of CH165442 retrieved from espacenet.com Nov. 12, 2024 (Year: 2024).*

* cited by examiner

*Primary Examiner* — Jessica Cahill
(74) *Attorney, Agent, or Firm* — Barley Snyder

(57) ABSTRACT

A drain trap assembly comprises an upper housing and an access fitting removably attached thereto. The upper housing includes a main body defining an open bottom end, an inlet pipe extending through the main body in a vertical direction and exiting through the open bottom end, and an outlet pipe extending from an annular sidewall of the main body. The access fitting is removably attached to the main body for selectively covering the open bottom end and defines a fluid reservoir in communication with the inlet pipe and the outlet pipe.

23 Claims, 7 Drawing Sheets

DRAIN TRAP ASSEMBLY

FIELD OF THE INVENTION

The present disclosure relates to the field of plumbing conduits, and more particularly, to an improved drain trap assembly for connecting a drain to a sewer line.

BACKGROUND

Traditional plumbing drain traps are arranged between a drain of a basin (e.g., a sink) and a waste or sewer line. These traps include "S-type" and "P-type" traps used to create a gas-obstructing compartment for blocking the flow of gas from downstream sewer lines into the basin to which the trap is fitted. These designs, however, provide little to no provisions for quick and easy clean-out, or to ensure continuous flow during use. Specifically, cleaning a typical S-type or P-type trap requires the removal of the whole trap, often necessitating the use of tools. Further, in these traditional traps, the introduction of a large object into the trap often significantly obstructs the flow of fluids therethrough. This in turn results in slow upstream drainage from the basin or sink. Further still, it is often difficult to determine if and/or where an obstruction is present along the drainage line or within the trap.

Accordingly, improved drain traps or drain trap assemblies are desired which address these deficiencies, while being easy to install, service and/or replace by non-professionals.

SUMMARY

A drain trap assembly according to an embodiment of the present disclosure comprises an upper housing and an access fitting removably attached thereto. The upper housing includes a main body defining an open bottom end, an inlet pipe extending through the main body in a vertical direction and exiting through the open bottom end, and an outlet pipe extending from an annular sidewall of the main body. The access fitting is removably attached to the main body over the open bottom end and defines a fluid reservoir in communication with the inlet pipe and the outlet pipe.

BRIEF DESCRIPTION OF THE DRAWINGS

The invention will now be described by way of example with reference to the accompanying figures, of which.

DETAILED DESCRIPTION OF THE EMBODIMENTS

Figure 1:
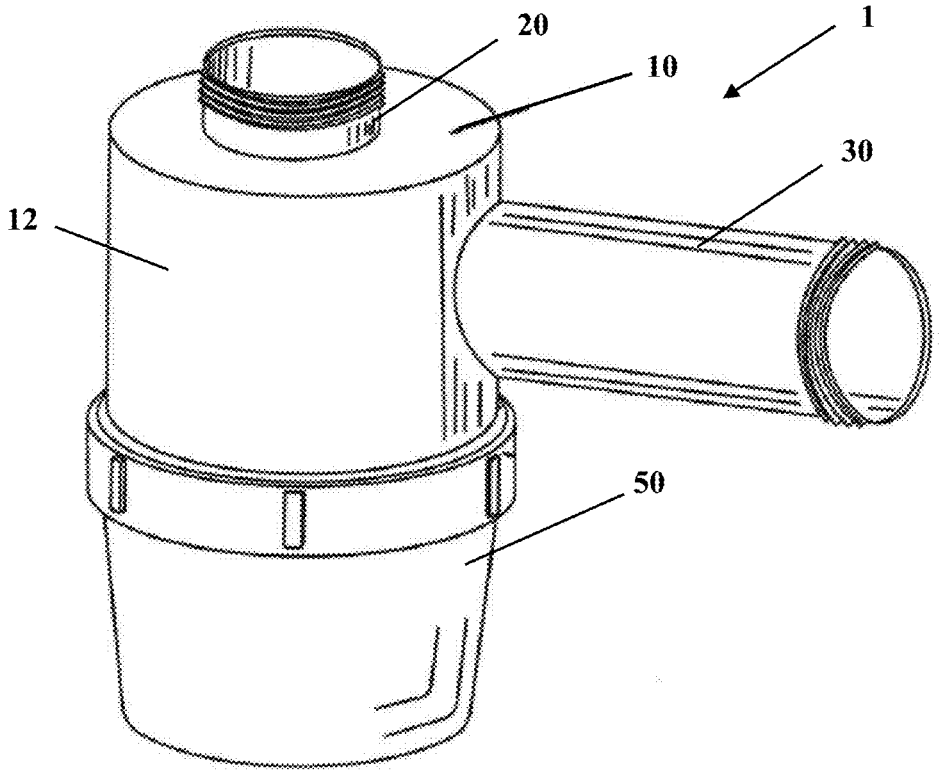
FIG. 1 is front perspective view of a drain trap assembly according to an embodiment of the present disclosure.
Figure 2:
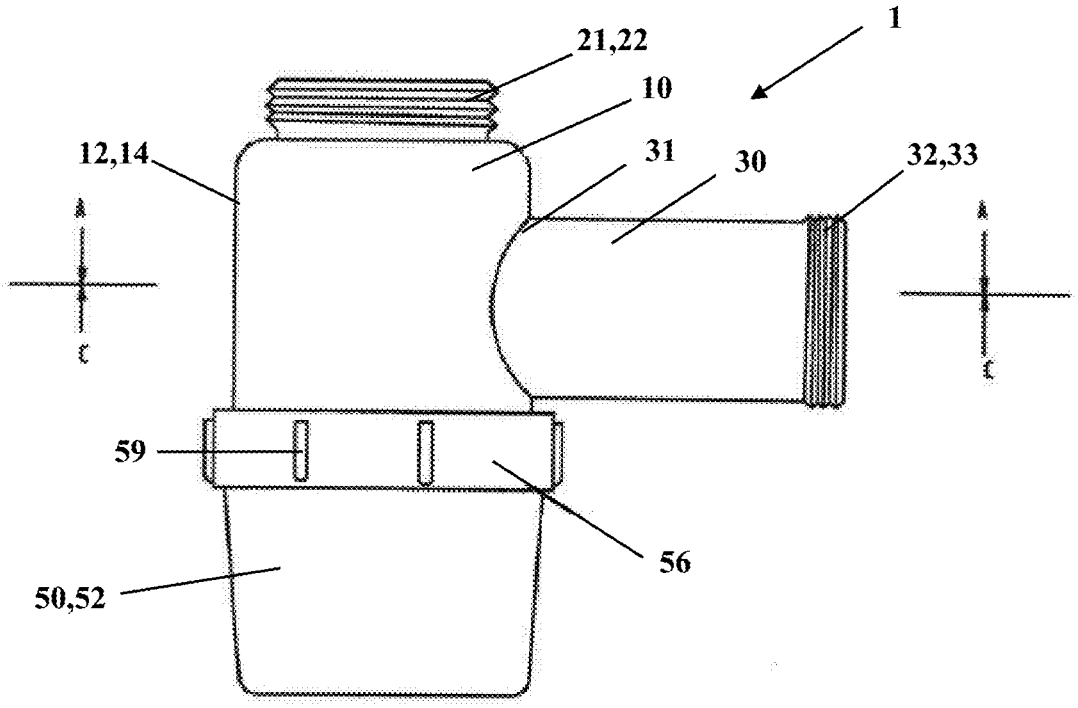
FIG. 2 is a front elevation view of the drain trap assembly of FIG. 1.
Figure 3:
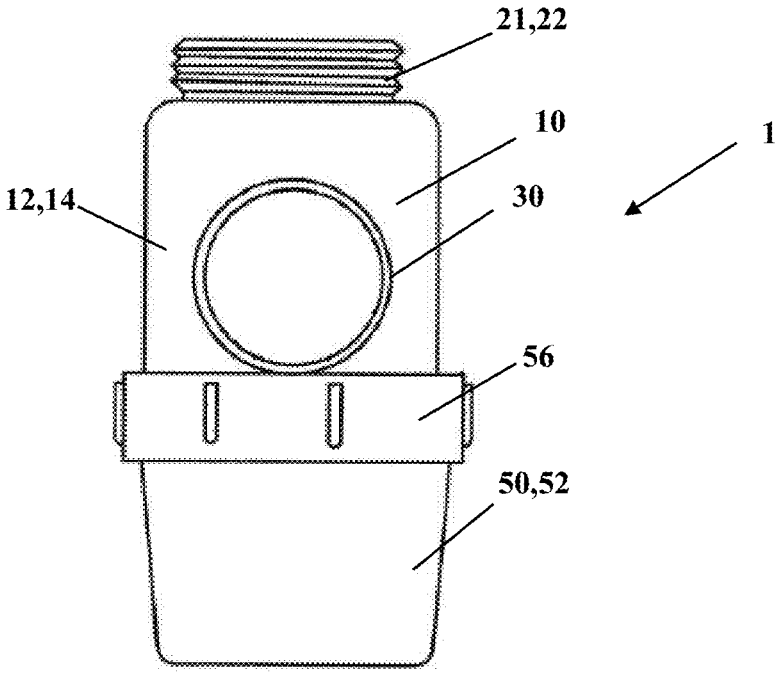
FIG. 3 is a right-side elevation view of the drain trap assembly of FIG. 1.
Figure 4:
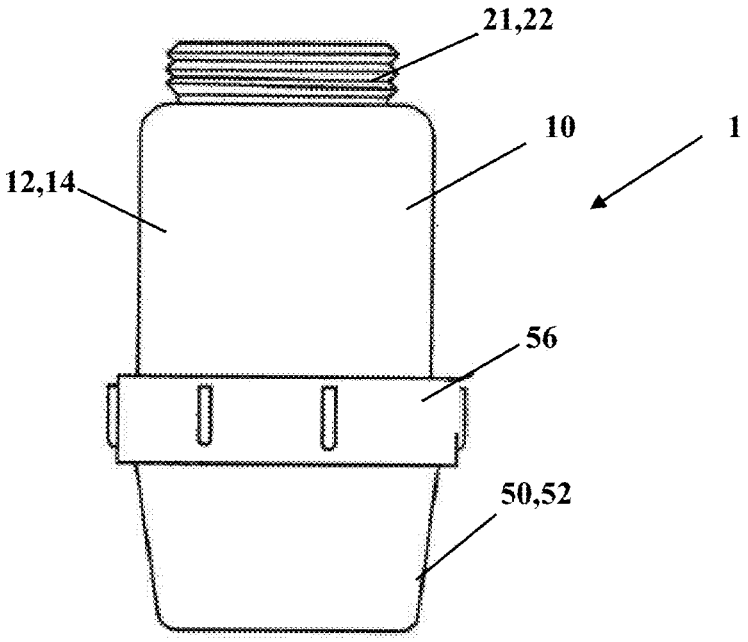
FIG. 4 is a left-side elevation view of the drain trap assembly of FIG. 1.
Figure 5:
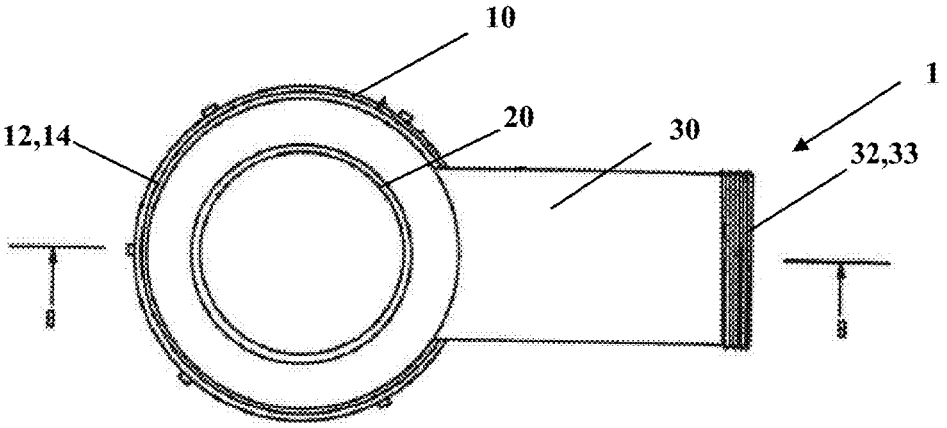
FIG. 5 is a top plan view of the drain trap assembly of FIG. 1.
Figure 6:
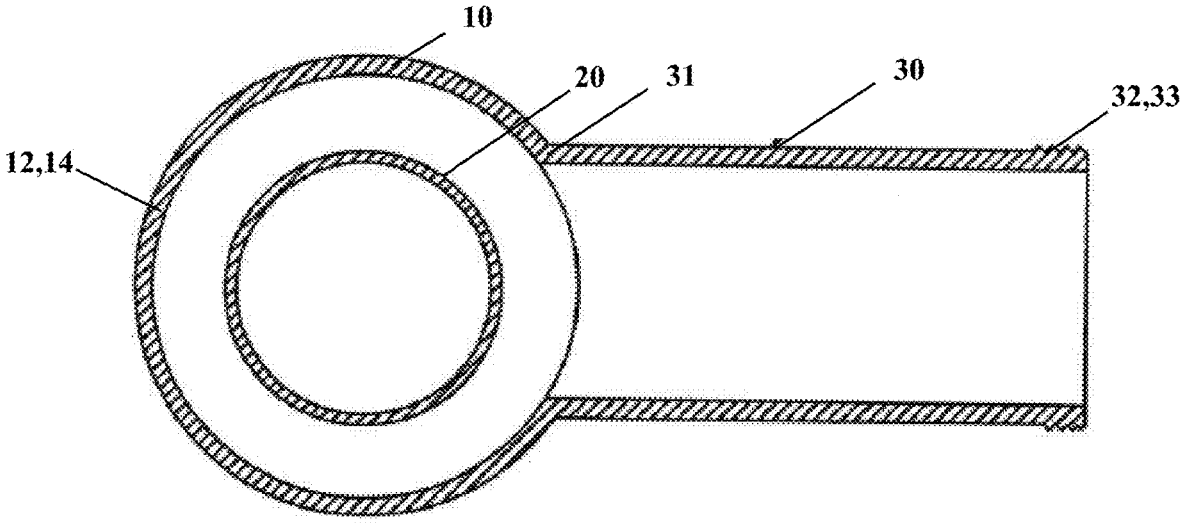
FIG. 6 is a cross-sectional view of the drain trap assembly of FIG. 1 taken along line A-A and/or C-C, as shown in FIG. 2, with an access fitting and a seal of the assembly removed for clarity.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present disclosure include a drain trap and associated plumping assemblies utilizing the same. Referring generally to FIG. 1, a drain trap or drain trap assembly 1 according to a first embodiment generally includes a pipe housing or upper housing 10, and a lower housing or access fitting 50 removably coupled (e.g., threaded) thereto. The upper housing 10 includes a cylindrical main body 12, a cylindrical inlet tube or pipe 20 adapted to be coupled to a drain pipe, and a cylindrical outlet tube or pipe 30 adapted to be coupled to a waste or sewer line. The access fitting 50 is a generally hollow, cup-like component defining an internal reservoir in communication with the inlet pipe 20 and the outlet pipe 30, as will be set forth in detail herein.

Figure 7:
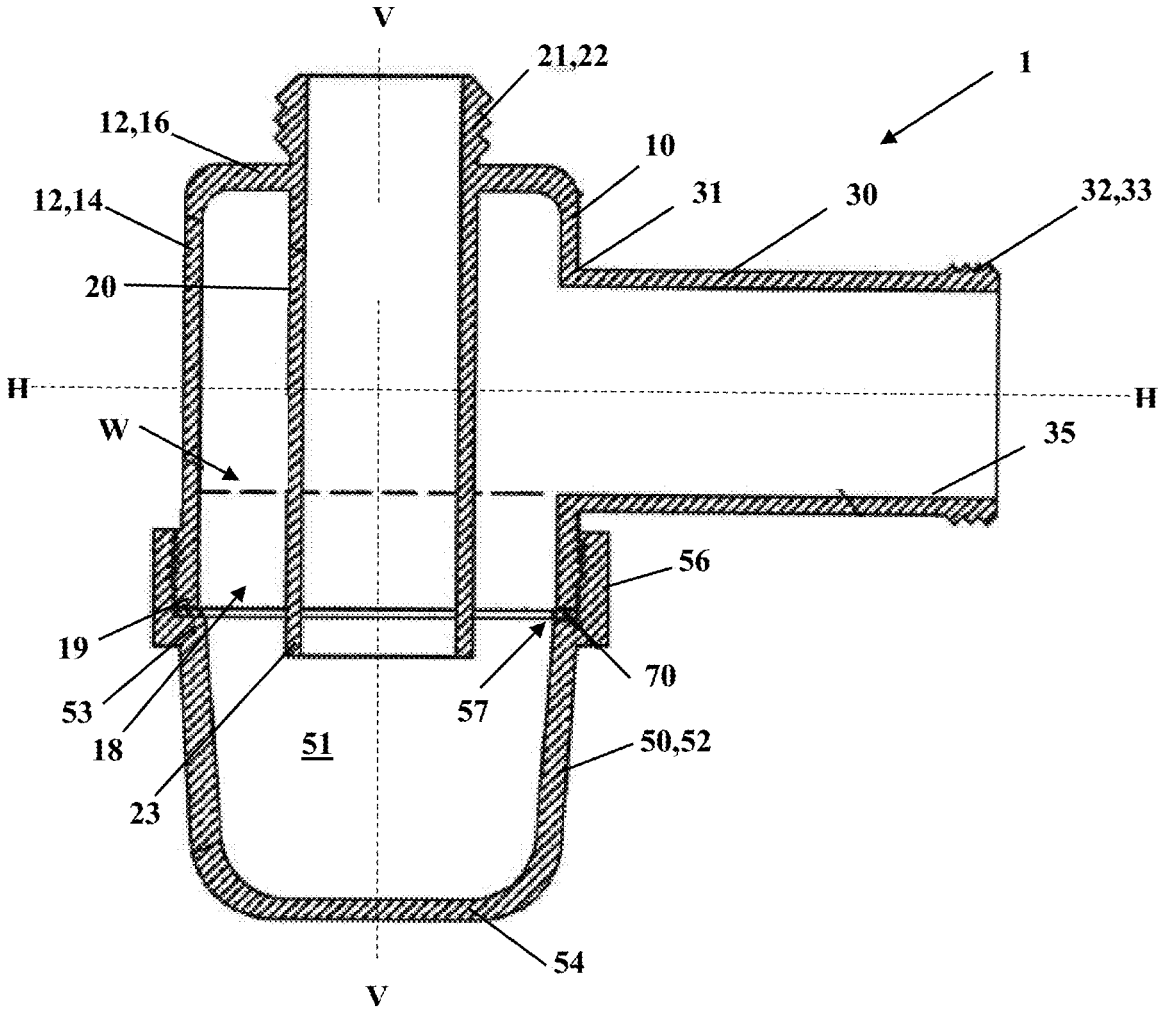
FIG. 7 is front cross-sectional view of the drain trap assembly of FIG. 1 taken along line B-B, as shown in FIG. 5.

Referring generally now to FIGS. 2-7, and in particular to the cross-sectional view of FIG. 7, the drain trap assembly 1 will now be described in greater detail. The main body 12 of the upper housing 10 comprises a generally cylindrical housing defined by an annular sidewall 14 and a generally planar, integral top wall 16. The annular sidewall 14 defines an open bottom end 18 of the upper housing 10. In one embodiment, the cylindrical main body 12 and inlet pipe 20 are aligned coaxially with one another along a vertical first central axis V, such that the inlet pipe extends through a center of the main body.

A first end 21 of the inlet pipe 20 extends vertically upward from, and is integrally formed with, the top wall 16 of the main body 12. More specifically, the inlet pipe 20 extends perpendicularly upward from an exterior side of the top wall 16 of the main body 12. The first end 21 of the inlet pipe 20 defines an external threading 22 extending radially outward therefrom. The threading 22 of the first end 21 is adapted to threadably engage with, for example, a slip joint nut for forming a seal with a drain pipe inserted into the first end.

The inlet pipe 20 extends perpendicularly downward from an internal side of the top wall 16 of the main body 12. In this way, the inlet pipe 20 extends into and through the main body 12. An outlet end 23 of the inlet pipe 20 extends beyond the opening 18 of main body 12 in the vertically downward direction. The inlet pipe 20 defines a constant inner diameter over its length, as well as a constant outer diameter between the inlet end 21 and the outlet end 23. In this way, the inlet pipe 20 is arranged equidistant in a radially inward direction from the generally cylindrical annular sidewall 14 of the main body 12.

The outlet pipe 30 extends outwardly from, and is integrally formed with, an exterior side of the annular sidewall 14 of the main body 12 on a first end 31 thereof. A second end 32 of the outlet pipe 30 may define an external threading 33 extending radially outward therefrom. The second end 32 of the outlet pipe 30 is adapted to receive and form a seal with a downstream conduit in communication with, for example, a sewer pipe. Like the first end 21 of the inlet pipe 20, the threading 33 of the outlet pipe 30 is adapted to engage with a standard slip joint nut. The outlet pipe 30 defines a constant inner diameter, as well as a constant outer diameter between the first end 31 and the second end 32.

In one embodiment, a central axis H of the outlet pipe 30 is oriented perpendicularly to the central axis V of the inlet pipe 20 and the main body 12. In this way, the outlet pipe 30 extends perpendicularly from the sidewall 14 of the main body 12. In the exemplary embodiment, the axes V, H are arranged on a common vertical plane such that the central axis H of the outlet pipe 30 intersects with the central axis V of the inlet pipe 20 and the main body 12 (i.e., the central axis of the outlet pipe extends in a radial direction from the central axis of the inlet pipe). In one embodiment, the outlet pipe 30 is arranged equidistant from the top wall 16 and a bottom 19 of the annular sidewall 14 of the main body 12. In other embodiments, the outlet pipe 30 is arranged such that its central axis H bisects the inlet pipe 20 midway along its total length.

The inner and outer diameters of the inlet pipe 20 are less than respective ones of the inner and outer diameters of the outlet pipe 30. In some embodiments, the outer diameter of the inlet pipe 20 is less than the inner diameter of the outlet pipe 30. In the illustrated embodiment, the wall thicknesses of the inlet pipe 20 and the outlet pipe 30, as well as the annular sidewall 14 of the main body 12 are constant. In some embodiments, the wall thicknesses of the inlet pipe 20, the outlet pipe 30 and the annular sidewall 14 are equal. The wall thickness of the top wall 16 is greater than that of the annular sidewall 14, the inlet pipe 20 and/or the outlet pipe 30. The total length of inlet pipe 20 is greater than that of the outlet pipe 30. Further, the length of an internal portion of the inlet pipe 20 arranged within the main body 12 is greater than the total length of the outlet pipe 30.

As set forth above, the main body 12, the inlet pipe 20 and the outlet pipe 30 are formed integrally with one another (e.g., via a molded polymer material or cast metal material) such that the upper housing 10 is formed as a single piece. This arrangement simplifies manufacturing and installation, increases product consistency and minimizes points of failure (e.g., excess joints which may develop leaks).

The access fitting 50 has a generally cylindrical shape, and more specifically, takes the form of a hollow tapered cylinder or hollow conical frustum. The access fitting 50 includes a linearly tapering annular sidewall 52, a bottom wall 54 and an annular mating flange 56 extending from an open end 53 of the annular sidewall 52. The access fitting 50 defines an internal fluid reservoir 51 in communication with the outlet end 23 of the inlet pipe 20 and an inlet end 31 of the outlet pipe 30, as shown in FIG. 7. The access fitting 50 is a unitary element, with the annular sidewall 52, the bottom wall 54 and the flange 56 formed integrally with one another. In one embodiment, the access fitting 50 is made of a transparent material such that the internal reservoir 51 is visible for inspection purposes without requiring the removal of the access fitting.

The mating flange 56 extends both radially outward and axially away from the open end 53 of the annular sidewall 52. An exterior surface of the flange 56 defines a plurality of circumferentially spaced, axially extending ribs 59, providing an effective gripping surface for installing and/or removing the access fitting 50. An interior surface of the flange 56 defines a threading adapted to threadably engage with a complementary threading formed on the bottom 19 of the annular sidewall 14 of the upper housing 10.

The mating flange 56 creates a radially extending recess 57 into which the bottom 19 of the sidewall 14 of the upper housing 10 is threadably received. The recess 57 is defined by the inner sidewall of the flange 56, and a top surface of the annular sidewall 52 which opposes a bottom surface of the annular sidewall 14 of the upper housing 10. A seal or sealing washer 70 is arranged between these opposed surfaces for forming a seal between the upper housing 10 and the access fitting 50. The seal 70 comprises an annular shape, with its width in the radial direction being greater than its thickness in the axial direction in an uncompressed state. In other embodiments, the seal 70 may be an O-ring seal having a generally constant cross-sectional diameter in an uncompressed state.

In one embodiment, an inner diameter of the annular sidewall 14 matches an inner diameter of the top of the annular sidewall 52. Further, the inner and outer diameters of the annular sidewall 52 proximate the bottom wall 54 are less than a respective one of the inner and outer diameters of the annular sidewall 14 proximate the bottom 19 thereof. Moreover, a length of the upper housing 10 is greater than the length of the access fitting 50 in the vertical or axial direction (i.e., along the first central axis V).

As shown in FIG. 7, in one embodiment, the second end 23 of the inlet pipe 20 extends into the access fitting 50. More specifically, the second end 23 extends to a depth below that of the mating flange 56 in the vertically downward direction. In this way, it is ensured that the second end 23 of the inlet pipe 20 remains sufficiently below a water line W defined by lower inner surface 35 of the outlet pipe 30. This arrangement reliably prevents sewer gasses from entering the inlet pipe 20 from the outlet pipe 30.

Figure 8:
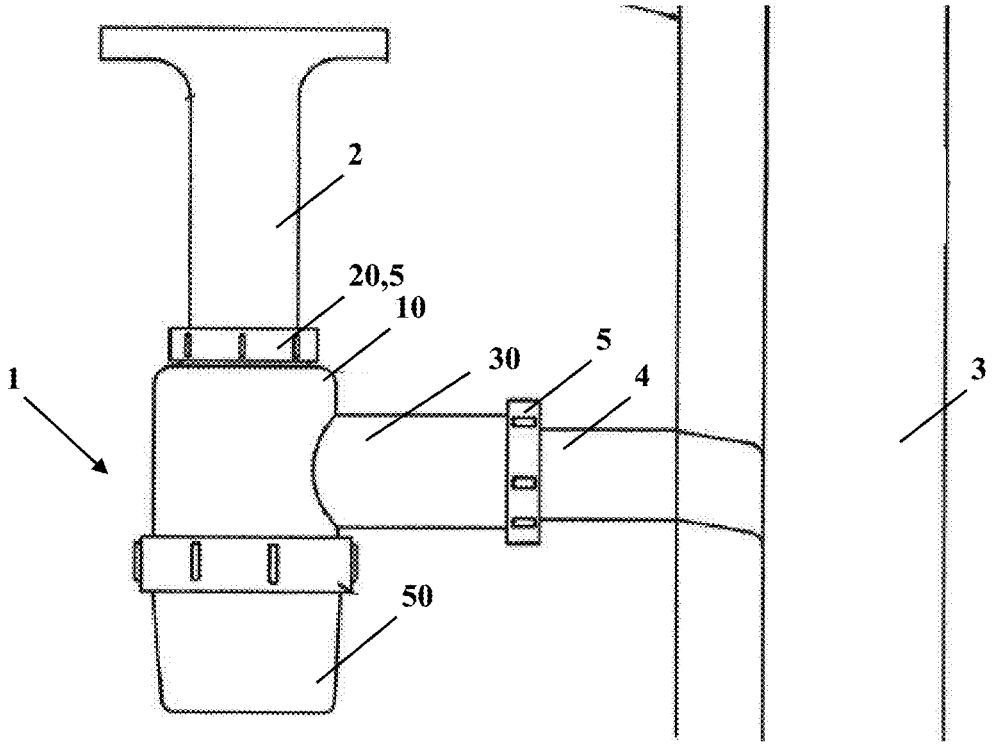
FIG. 8 is a front elevation view of the drain trap assembly of FIG. 1 in use in a drain system.

Referring generally to FIG. 8, the drain trap assembly 1 forms part of a drain system including a drain pipe 2 (i.e., extending from a sink or other basin) and a vertically oriented sewer pipe 3. The drain pipe 2 is received within the inlet pipe 20 and forms a seal therewith via, for example, a first slip joint nut 5 and associated internal seal. Similarly, the second end of the outlet pipe 30 receives an intermediate pipe or branch 4 of the sewer pipe 3 therein. This joint may also be sealed via a second slip joint coupling nut 5 and associated internal seal. As shown, the drain trap assembly 1 is adapted to replace an existing P-type trap without requiring any further modification of the drain pipe 2, the intermediate pipe 4 and/or the sewer pipe 3.

Figure 9:
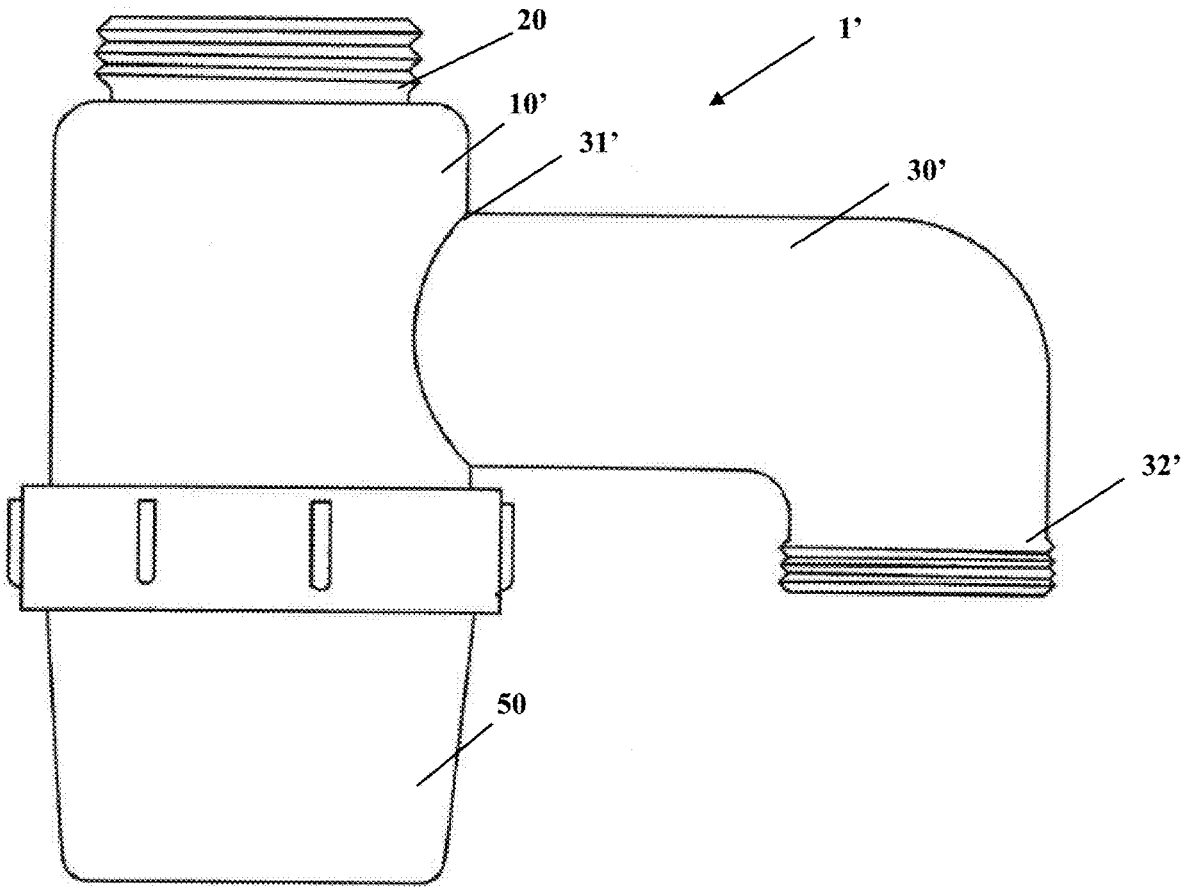
FIG. 9 is front perspective view of a drain trap assembly according to another embodiment of the present disclosure.
Figure 10:
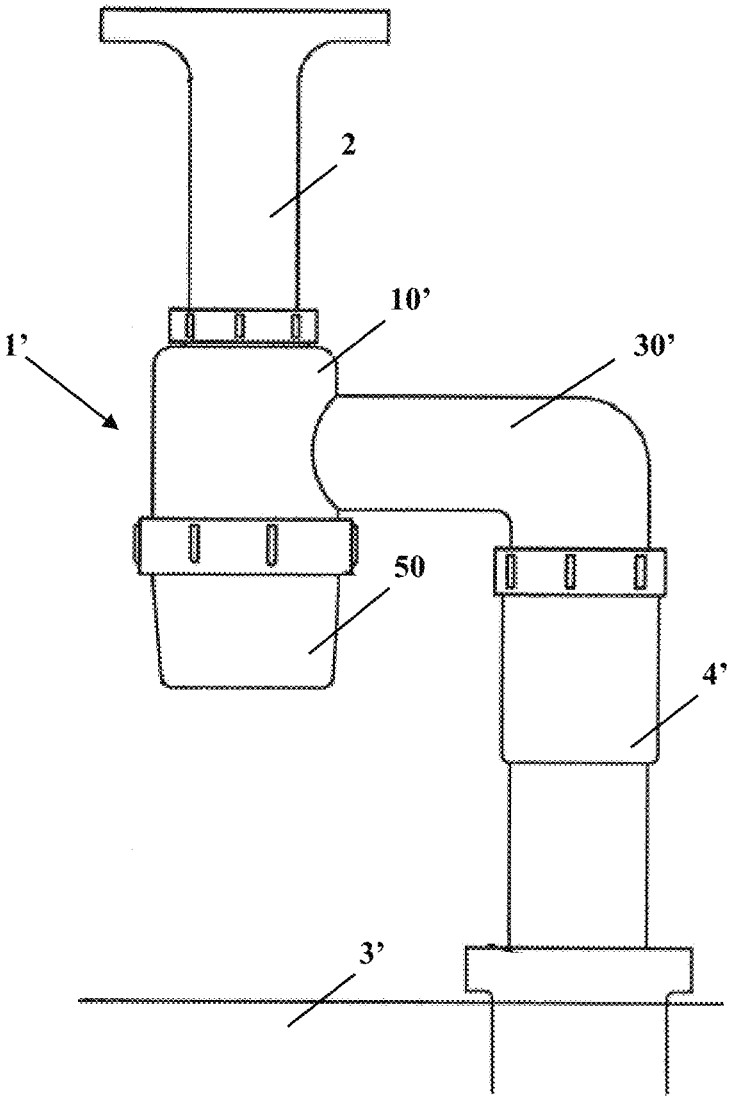
FIG. 10 is a front elevation view of the drain trap assembly of FIG. 9 in use in a drain system.

Referring now to FIGS. 9 and 10, a drain trap assembly 1' according to another embodiment of the present disclosure is provided. Unless otherwise noted, it should be understood that the trap assembly 1' comprises identical features to those set forth above with respect to the trap assembly 1. In this embodiment, however, the upper housing 10' is formed with an outlet pipe 30' having a generally "L-shaped" profile. Specifically, the outlet pipe 30' defines a 90-degree bend between its inlet and outlet ends 31', 32'. As shown in FIG. 10, the drain trap assembly 1' is adapted to connected to the drain pipe 2 and a horizontally oriented sewer pipe 3' via an intermediate pipe 4'. In this way, the drain trap assembly 1' is adapted to directly replace an S-type trap without requiring any additional modification to the other components of the system.

Trap assemblies according to the above-described embodiments provide several advantages over traps of the prior art. These advantages are realized by above-described structure, including the relative component dimensions and positioning set forth in detail herein. For example, embodiments described herein provide a uniform interior channel allowing for the free flow of fluid and small objects, while trapping large objects without any resulting flow obstruction. The lower access fitting is separable from the integrally connected inlet and outlet pipes, tubes or segments, facilitating easy access to the interior of the trap for the removal of large, trapped debris. The lower access fitting is also adapted to be removable without tools, and by non-professionals with relative ease.

The trap may be formed of a rigid polymer material via, for example, molding operations. In other embodiments, the trap assembly may be formed of cast metal, such as iron, or from copper or brass. In this way, the trap assembly may be used in industrial applications in addition to residential applications. In one particularly advantageous embodiment, at least the access fitting, if not the entire assembly, may be formed from a transparent material. In this way, a user can easily inspect the trap without requiring its disassembly. The trap assembly blocks sewer gases, and is a direct replacement of P-type and S-type trap assemblies. Due to the integral construction, the trap assembly can be installed with increased ease.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A drain trap assembly, comprising:

an upper housing, including:

a main body defining an open bottom end, an annular sidewall, and a top wall, the annular sidewall of the main body extending from the top wall to the open bottom end and defining an at least partially cylindrical body having a constant diameter along its length;

an inlet pipe extending vertically upward from, and is integrally formed with the top wall of the main body and having a constant inner and outer diameter over its length, extending through the main body in a vertical direction and exiting through the open bottom end;

an outlet pipe having a constant inner and outer diameter between a first end of the outlet pipe and a second end of the outlet pipe, extending from the annular sidewall of the main body, the outer diameter of the inlet pipe is less than the inner diameter of the outlet pipe;

an access fitting removably attached to the main body and covering the open bottom end, the access fitting defining a fluid reservoir in unrestricted communication with the inlet pipe and the outlet pipe.

2. The drain trap assembly of claim 1, wherein the upper housing, the inlet pipe and the access fitting each have an at least partially circular cross-section defined about a common vertical first central axis.

3. The drain trap assembly of claim 2, wherein a horizontal second central axis of the outlet pipe is arranged perpendicular to the first central axis, the first central axis and the second central axis defined on a common vertical plane.

4. The drain trap assembly of claim 3, wherein the second central axis of the outlet pipe is oriented at a midpoint of the annular sidewall of the main body in the vertical direction.

5. The drain trap assembly of claim 2, wherein:

the annular sidewall of the main body, the inlet pipe and the access fitting are coaxially aligned;

the inlet pipe defines a hollow cylindrical body having a constant diameter; and the access fitting defines a hollow tapered cylinder.

6. The drain trap assembly of claim 2, wherein a first end of the inlet pipe extends outwardly from a top of the main body along the first central axis, and the first end of the outlet pipe extends outwardly from the annular sidewall of the main body to the second end of the outlet pipe along the second central axis.

7. The drain trap assembly of claim 6, wherein:

the first end of the inlet pipe defines an external threading adapted to threadably engage with a first slip joint nut for connecting the inlet pipe to a drain pipe; and the second end of the outlet pipe defines an external threading adapted to threadably engage with a second slip joint nut for connecting the outlet pipe to a sewer pipe.

8. The drain trap assembly of claim 6, wherein a second end of the inlet pipe extends into the access fitting.

9. The drain trap assembly of claim 8, wherein:

the access fitting defines a threaded mounting flange formed about an open top end thereof and threadably engaging with an exterior threading formed on a bottom end of the annular sidewall of the main body; and the flange defines an internal annular step having a mating surface opposing a bottom surface of the bottom end of the annular sidewall of the main body in the vertical direction.

10. The drain trap assembly of claim 9, further comprising a seal arranged on the annular step and between the mating surface and the bottom surface of the annular sidewall of the main body.

11. The drain trap assembly of claim 9, wherein the second end of the inlet pipe extends into the access fitting to a depth greater than the mounting flange in the vertical direction.

12. The drain trap assembly of claim 1, wherein the inlet pipe has a length greater than a length of the outlet pipe.

13. The drain trap assembly of claim 1, wherein the access fitting includes a tapered annular sidewall and a bottom wall defining the reservoir, the tapered annular sidewall having a height in the vertical direction greater than an external diameter of the outlet pipe.

14. The drain trap assembly of claim 1, wherein the inlet pipe and the outlet pipe are formed integrally with one another.

15. The drain trap assembly of claim 1, wherein the access fitting is formed from a transparent material.

16. The drain trap assembly of claim 1, wherein the outlet pipe is arranged equidistant from the top wall and a bottom of the annular sidewall of the main body.

17. The drain trap assembly of claim 1, wherein the inlet pipe is arranged equidistant in a radially inward direction from the annular sidewall of the main body.

18. The drain trap assembly of claim 1, wherein a wall thickness of the top wall is greater than a wall thickness of the annular sidewall.

19. The drain trap assembly of claim 1, wherein the top wall extends perpendicular to the annular sidewall of the main body.

20. A drain trap system, comprising:

a drain pipe;

a sewer pipe; and a drain trap assembly, comprising:

an upper housing, including:

a main body defining an open bottom end, an annular sidewall, and a top wall, the annular sidewall of the main body extending from the top wall to the open bottom end and defining an at least partially cylindrical body having a constant diameter along its length;

an inlet pipe extending vertically upward from, and is integrally formed with the top wall of the main body and having a constant inner and outer diameter over its length, extending through the main body and including a first end of the inlet pipe connected to the drain pipe and a second end of the inlet pipe exiting through the open bottom end;

an outlet pipe, having a constant inner and outer diameter between a first end of the outlet pipe and a second end of the outlet pipe, the outlet pipe additionally having the first end of the outlet pipe extending from the annular sidewall of the main body and having the second end of the outlet pipe connected to the sewer pipe, the outer diameter of the inlet pipe is less than the inner diameter of the outlet pipe; and an access fitting removably attached to the main body and covering the open bottom end, the access fitting defining a fluid reservoir in unrestricted communication with the inlet pipe and the outlet pipe.

21. The system of claim 20, wherein the inlet pipe is directly connected to the drain pipe via a first slip joint nut, and the outlet pipe is connected to the sewer pipe via a second slip joint nut.

22. The system of claim 20, wherein the outlet pipe is a linear pipe extending perpendicularly relative to the inlet pipe, and the drain trap assembly is adapted to replace a P-type drain trap.

23. The system of claim 20, wherein the outlet pipe is a non-linear pipe having:

a first section extending perpendicularly relative to the inlet pipe; and a second section extending perpendicularly from the first section in a direction of the inlet pipe, and the drain trap assembly adapted to replace an S-type drain trap.

* * * * *